US008721355B2

(12) United States Patent
Belack

(10) Patent No.: US 8,721,355 B2
(45) Date of Patent: May 13, 2014

(54) ELECTRICAL CONNECTOR WITH HOOD

(75) Inventor: Dustin Carson Belack, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/364,048

(22) Filed: Feb. 1, 2012

(65) Prior Publication Data

US 2013/0194769 A1 Aug. 1, 2013

(51) Int. Cl.
*H01R 13/44* (2006.01)

(52) U.S. Cl.
USPC ..... 439/141

(58) Field of Classification Search
USPC ..... 439/140, 700, 289
See application file for complete search history.

(56) References Cited

U.S. PATENT DOCUMENTS

| | | | | |
|---|---|---|---|---|
| 3,508,188 | A | 4/1970 | Buck | |
| 4,426,910 | A | 1/1984 | Speer | |
| 5,179,235 | A | 1/1993 | Toole | |
| 5,435,091 | A | 7/1995 | Toole et al. | |
| 5,557,872 | A | 9/1996 | Langner | |
| 5,597,317 | A * | 1/1997 | Hansell et al. | 439/289 |
| 5,704,153 | A | 1/1998 | Kaminski et al. | |
| 5,706,600 | A | 1/1998 | Toole et al. | |
| 5,924,879 | A * | 7/1999 | Kameyama | 439/289 |
| 6,231,358 | B1 * | 5/2001 | Kerr et al. | 439/140 |
| 6,434,875 | B1 | 8/2002 | Constant et al. | |
| 6,671,991 | B1 | 1/2004 | Danielson | |
| 7,128,592 | B2 * | 10/2006 | Li | 439/289 |
| 7,260,910 | B2 | 8/2007 | Danielson | |
| 7,338,288 | B1 | 3/2008 | Kung et al. | |
| 7,627,975 | B1 | 12/2009 | Hines | |
| 7,743,547 | B2 | 6/2010 | Houde-Walter | |
| 2006/0148301 | A1 | 7/2006 | Kim | |
| 2010/0083553 | A1 | 4/2010 | Montgomery | |
| 2010/0192443 | A1 | 8/2010 | Cabahug et al. | |
| 2010/0192448 | A1 | 8/2010 | Darian | |

FOREIGN PATENT DOCUMENTS

| | | |
|---|---|---|
| GB | 2 264 201 A | 8/1993 |
| WO | 9429664 | 12/1994 |
| WO | 2010053436 A1 | 5/2010 |

OTHER PUBLICATIONS

Annex to European Search Report, Mail Date, Mar. 14, 2013, EP 13 15 3303, Application No. 13153303.6-1801.
U.S. Appl. No. 13/215,649, filed Aug. 23, 2011.
International Search Report, International Application No. PCT/US2012/050852, International Filing Date, Aug. 15, 2012.

* cited by examiner

*Primary Examiner* — Phuong Dinh

(57) ABSTRACT

An electrical connector includes a housing having an internal compartment. A dielectric insert is held within the internal compartment of the housing. The dielectric insert includes an end face. An electrical contact is held by the dielectric insert and includes a mating segment that extends a length outwardly from the end face of the dielectric insert along a connection axis. A hood is held by the housing and has an extended position relative to the end face of the dielectric insert wherein the hood extends a length outwardly relative to the end face. The hood extends at least partially around the mating segment of the electrical contact in the extended position. The hood is retractable along the connection axis from the extended position to a retracted position wherein at least a portion of the length of the hood is retracted relative to the end face of the dielectric insert.

20 Claims, 9 Drawing Sheets

ELECTRICAL CONNECTOR WITH HOOD

BACKGROUND OF THE INVENTION

The subject matter herein relates generally to electrical connectors.

Weapons, such as AR-15s, M4's, M-16's, and others, include a rail having electronics mounted to or within the upper rail. The upper rail may include a laser, night vision scope, camera or other type of electronic that needs power. The electronics may also send or receive data. The weapons typically include electronics, including batteries, in the lower part of the weapon, such as in the butt stock, hand grip, lower receiver, which are communicatively connected to the electronics in the upper rail.

Connecting the electronics in the lower part of the weapon with the electronics in the upper rail has heretofore proven difficult. Some systems use wires along the outside of the gun that interconnect the electronics in the lower part of the weapon with the electronics in the upper rail. The wires tend to catch or snag or are exposed to be easily damaged, which is problematic. Other systems route wires internally, however the upper and lower receivers need to be completely redesigned, and thus are not compatible with existing parts. Additionally, the weapons are often disassembled, such as for cleaning, and having the internal wiring makes disassembly difficult.

At least some known weapons include connector systems for connecting the electronics in the upper and lower parts of the weapon. Specifically, the upper and lower parts may be provided with electrical connectors that, when mated together, establish an electrical connection between the electronics in the upper and lower parts of the weapon. But, known connector systems are not without disadvantages. Mud, sand, dirt, dust, and/or other debris may infiltrate the electrical connectors, for example during use of the weapon within the field and/or during disassembly, cleaning, and/or repair of the weapon. Such debris may inhibit operation of the electrical connectors. But, it may be difficult to clean the debris from the electrical connectors without damaging the electrical contacts of the electrical connectors.

BRIEF DESCRIPTION OF THE INVENTION

In one embodiment, an electrical connector includes a housing having an internal compartment. A dielectric insert is held within the internal compartment of the housing. The dielectric insert includes an end face. An electrical contact is held by the dielectric insert and includes a mating segment that extends a length outwardly from the end face of the dielectric insert along a connection axis. A hood is held by the housing and has an extended position relative to the end face of the dielectric insert wherein the hood extends a length outwardly relative to the end face. The hood extends at least partially around the mating segment of the electrical contact in the extended position. The hood is retractable along the connection axis from the extended position to a retracted position wherein at least a portion of the length of the hood is retracted relative to the end face of the dielectric insert.

In another embodiment, a weapon includes a base having a lower receiver. The base houses electronics therein. The weapon also includes an upper part having an upper receiver that is removably attachable to the lower receiver. The upper part houses electronics therein. The weapon also includes a communication connector system communicatively connecting the electronics of the base with the electronics of the upper part. The communication connector system includes upper and lower connectors coupled to the upper and lower receivers, respectively. The upper and lower connectors are communicatively connected to the electronics in the upper part and the base, respectively. The upper connector and/or the lower connector includes a housing having an internal compartment, a dielectric insert held within the internal compartment of the housing, and an electrical contact held by the dielectric insert. The electrical contact includes a mating segment that extends a length outwardly from the dielectric insert. A hood is held by the housing. The hood has an extended position relative to the dielectric insert. The hood extends at least partially around the mating segment of the electrical contact in the extended position. The hood is retractable from the extended position to a retracted position wherein at least a portion of the length of the hood is retracted relative to the dielectric insert.

In another embodiment, an electrical connector includes a housing having an internal compartment, and a dielectric insert held within the internal compartment of the housing. The dielectric insert includes an end face. An electrical contact is held by the dielectric insert. The electrical contact includes a mating segment that extends a length outwardly from the end face of the dielectric insert along a connection axis. The mating segment is retractable along the connection axis in a direction generally toward the dielectric insert. A hood is held by the housing. The hood has an extended position relative to the end face of the dielectric insert wherein the hood extends a length outwardly relative to the end face. The hood extends at least partially around the mating segment of the electrical contact in the extended position. The hood is retractable along the connection axis from the extended position to a retracted position wherein at least a portion of the length of the hood is retracted relative to the end face of the dielectric insert.

DETAILED DESCRIPTION OF THE INVENTION

Figure 1:
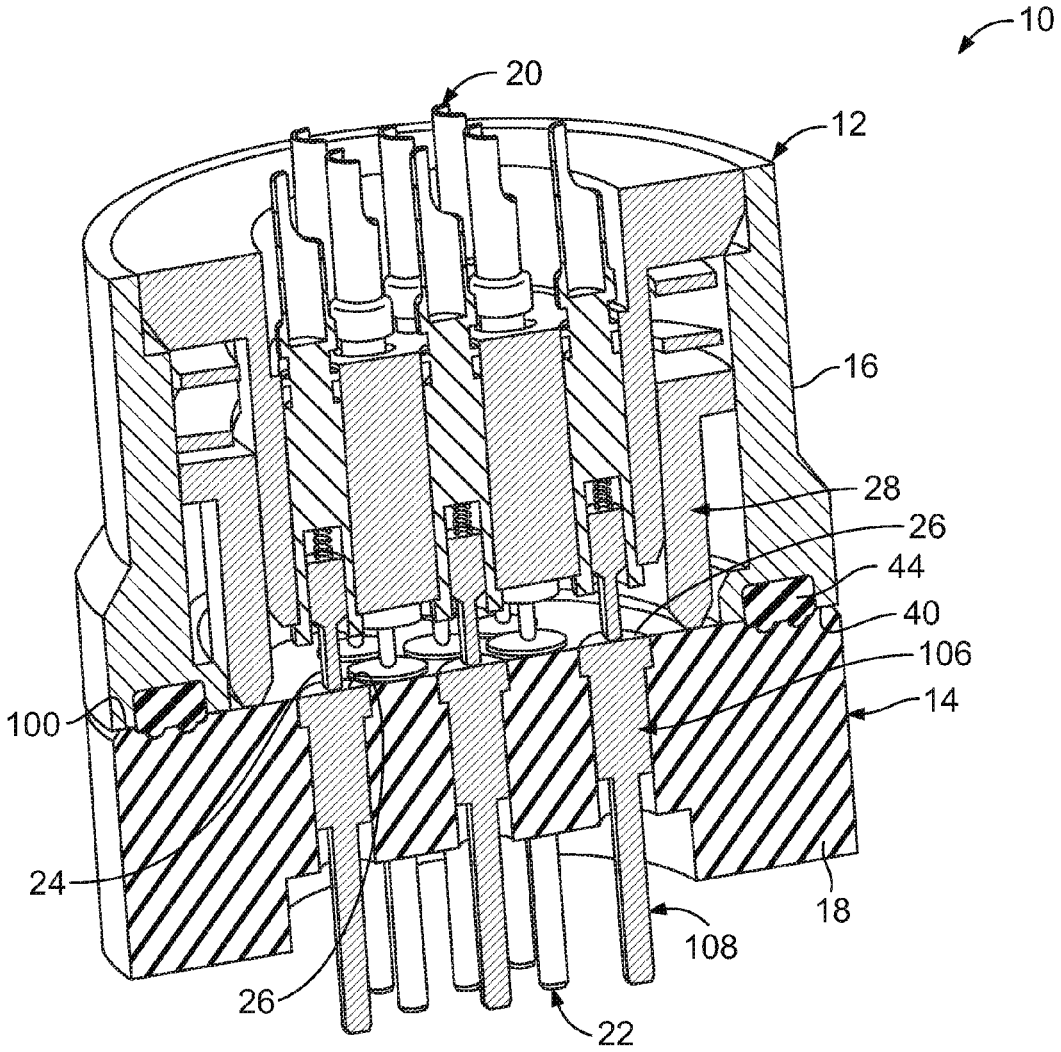
FIG. 1 is a perspective view illustrating a cross section of an exemplary embodiment of a connector system.

FIG. 1 is a perspective view illustrating a cross section of an exemplary embodiment of a connector system 10. The connector system includes a pair of electrical connectors 12 and 14 that mate together to establish an electrical connection therebetween. Each of the electrical connectors 12 and 14 includes a respective housing 16 and 18 that holds one or more electrical contacts 20 and 22, respectively. When the electrical connectors 12 and 14 are mated together, mating segments 24 of the electrical contacts 20 engage mating segments 26 of the electrical contacts 22 to electrically interconnect the electrical connectors 12 and 14.

As will be described below, the electrical connector 12 and/or the electrical connector 14 may include a retractable hood 28 that is retractable from an extended position wherein the hood extends at least partially around the mating segments 24 and/or 26, respectively, of the electrical contacts 20 and/or 22, respectively. As will also be described below, the mating segments 24 and/or 26 of the electrical contacts 20 and/or 22, respectively, may be retractable.

The connector system 10 may be used to interconnect a wide variety of electrical components. For example, the connector system 10 may be used as a component of a weapon (e.g., the weapon 200 shown in FIGS. 10 and 11) for interconnect various electrical components of the weapon. But, the connector system 10 is not limited to being used with weapons. Rather, the connector system 10 may be used to interconnect any electrical components and may be used as a component of any other device, structure, machine, component, and/or the like besides a weapon. Each of the electrical connectors 12 and 14 may be referred to herein as a "mating connector".

Figure 2:
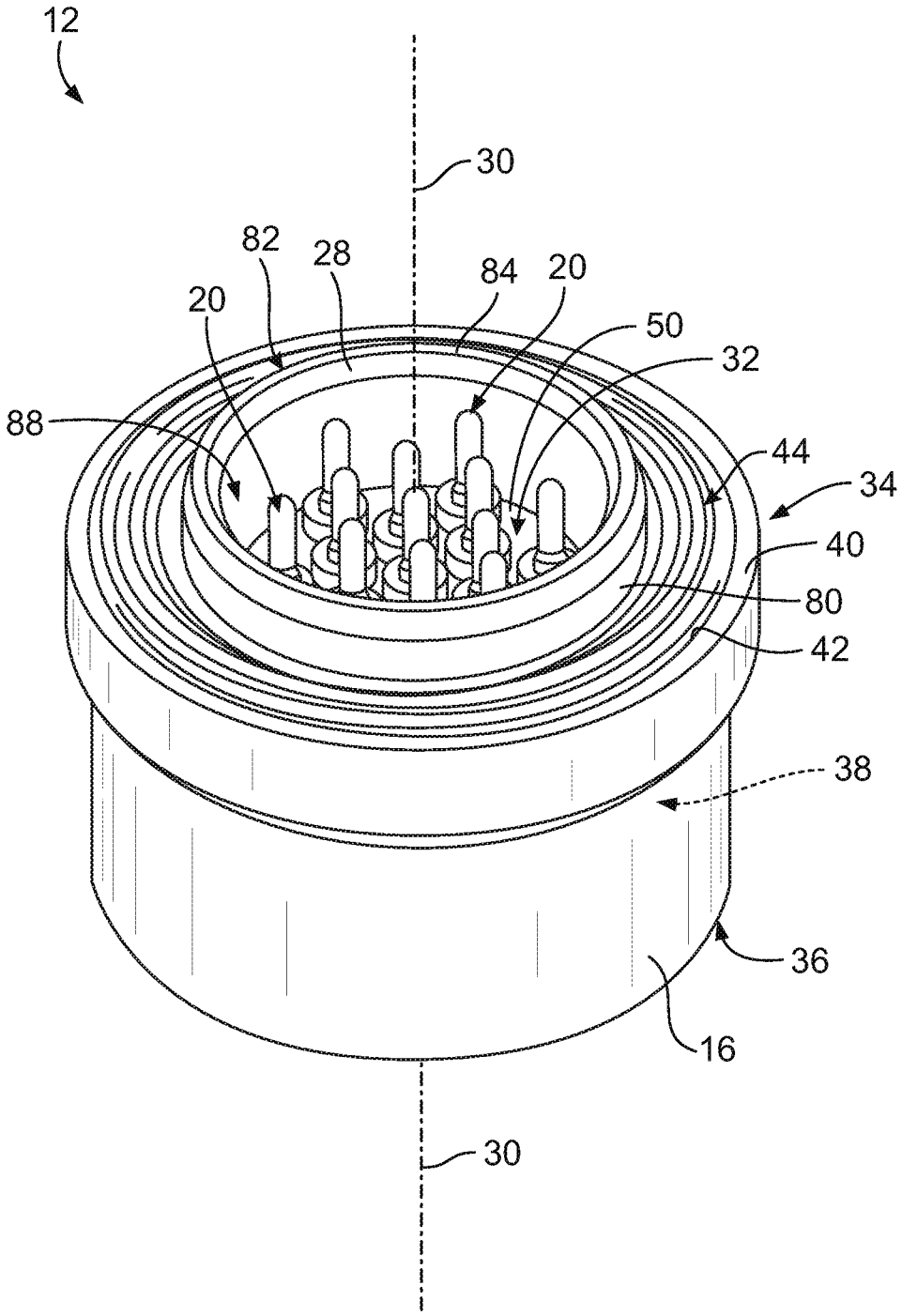
FIG. 2 is a perspective view of an exemplary embodiment of an electrical connector of the connector system shown in FIG. 1.
Figure 3:
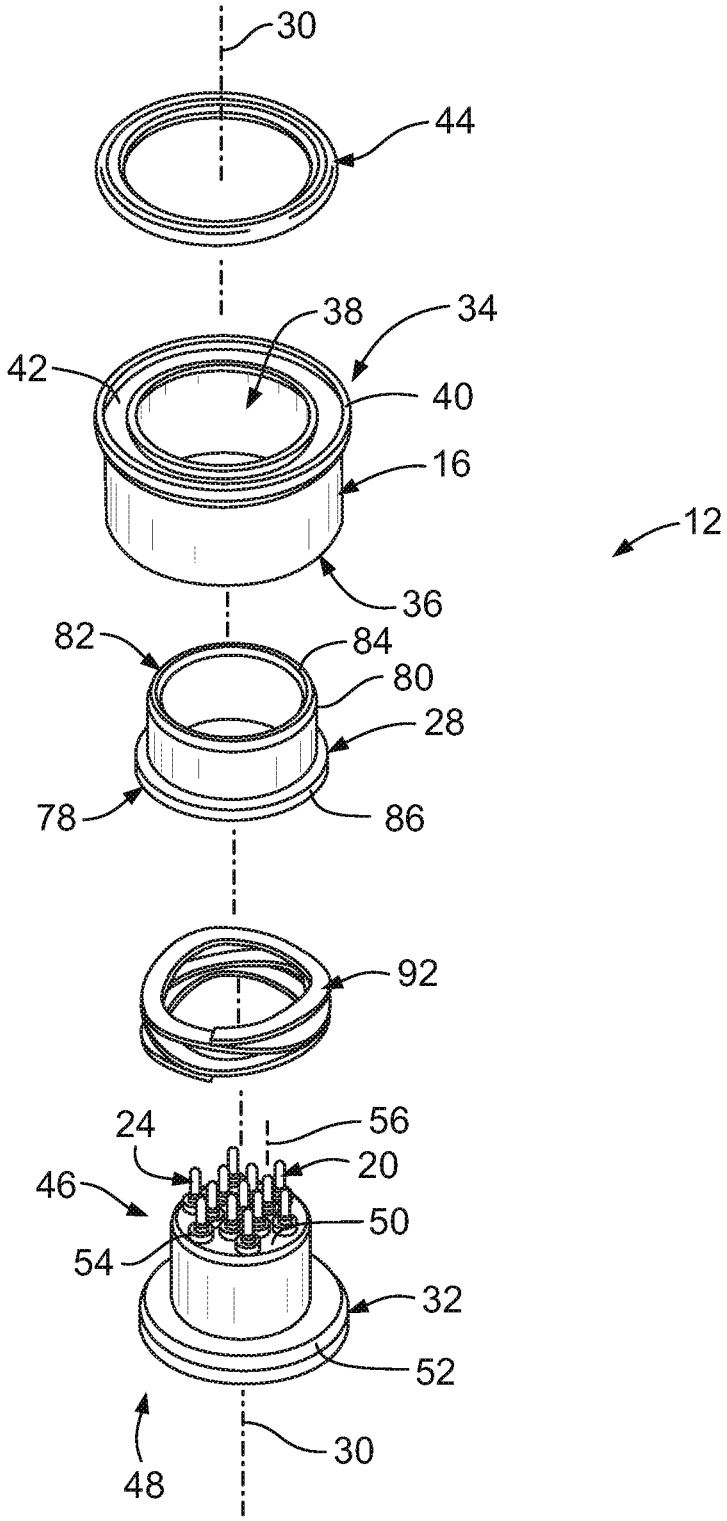
FIG. 3 is an exploded perspective view of the electrical connector shown in FIG. 2.
Figure 4:
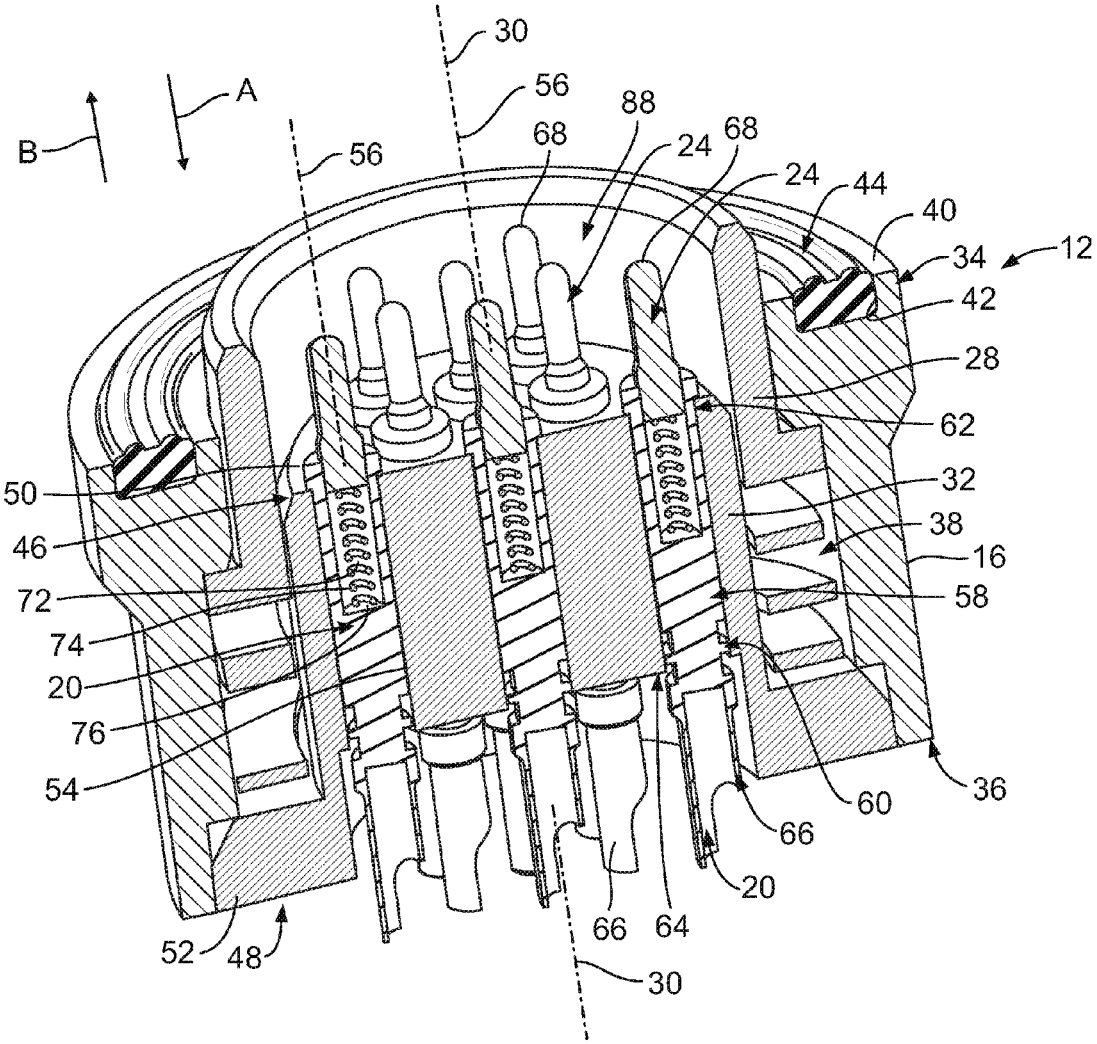
FIG. 4 is a perspective view illustrating a cross section of the electrical connector shown in FIGS. 2 and 3.

FIG. 2 is a perspective view of an exemplary embodiment of the electrical connector 12. FIG. 3 is an exploded perspective view of the electrical connector 12. FIG. 4 is a perspective view illustrating a cross section of the electrical connector 12. Referring now to FIGS. 2-4, the electrical connector 12 extends along a central longitudinal axis 30 and includes the housing 16, a dielectric insert 32, the electrical contacts 20, and the hood 28. The housing 16 extends a length along the central longitudinal axis 30 from an end 34 to an opposite end 36. The housing 16 includes an internal compartment 38 that, in the exemplary embodiment, extends through the length of the housing 16. The end 34 of the housing 16 includes a mating face 40 that faces the housing 18 (FIGS. 1 and 9) of the electrical connector 14 (FIGS. 1 and 9) when the electrical connectors 12 and 14 are mated together. The mating face 40 optionally includes a groove 42 that is configured to receive an optional seal 44.

The dielectric insert 32 is held within the internal compartment 38 of the housing 16. Referring now to FIGS. 3 and 4, the dielectric insert 32 includes a dielectric body that extends a length along the central longitudinal axis 30 from an end 46 to an opposite end 48. The end 46 includes an end face 50. In the exemplary embodiment, the end 48 of the body of the dielectric insert 32 includes a flange 52 that extends radially outwardly relative to the central longitudinal axis 30.

One or more contact openings 54 extend through the length of the body of the dielectric insert 32. The contact openings 54 are configured to hold corresponding electrical contacts 20 of the electrical connector 12 therein. The body of the dielectric insert 32 may include any number of the contact openings 54 for holding any number of electrical contacts 20.

The electrical contacts 20 of the electrical connector 12 are held by the dielectric insert 32. Specifically, the electrical contacts 20 are held within the contact openings 54 of the body of the dielectric insert 32. Each electrical contact 20 includes the mating segment 24. The electrical contacts 20 are held within the contact openings 54. When the mating segment 24 of an electrical contact 20 is in an extended position (e.g., as shown in FIGS. 2-4), the mating segment 24 extends a length outwardly from the end face 50 of the dielectric insert 32 along a corresponding connection axis 56. The connection axes 56 may extend approximately parallel to the central longitudinal axis 30 of the electrical connector 12, as is shown in the exemplary embodiment.

Each electrical contact 20 may be a signal contact, a ground contact, or an electrical power contact. Although thirteen are shown, the electrical connector 12 may include any number of the electrical contacts 20. In the exemplary embodiment, the mating segment 24 of each electrical contact 20 is a pin, however, each mating segment 24 may additionally or alternatively include any other structure, type of contact, and/or the like, such as, but not limited to, a spring, a receptacle, an arm, a tab, a pad, and/or the like.

Referring now to FIG. 4, each electrical contact 20 includes an intermediate segment 58 that extends within the corresponding contact opening 54. The intermediate segments 58 optionally include one or more retention features 60 that facilitate holding the intermediate segments 58 within the contact openings 54, for example with a snap or interference fit connection. The intermediate segments 58 extend lengths from ends 62 to opposite ends 64.

At the end 64, each electrical contact 20 includes a termination segment 66. The termination segment 66 is configured to be electrically connected to an electrical component, such as, but not limited to, an electrical wire, an electrical cable, another electrical contact, a circuit board, an electrical device, and/or the like. In the exemplary embodiment, the termination segments 66 extend along the end 36 of the housing 16.

Optionally, one or more of the mating segments 24 of the electrical contacts 20 is retractable from the extended position. In the exemplary embodiment, each of the mating segments 24 is retractable from the extended position, however, in other embodiments one or more of the mating segments 24 is not retractable from the extended position. In some embodiments, none of the mating segments 24 are retractable from the extended position. As shown in FIGS. 2-4, each of the mating segments 24 is in the extended position.

In the exemplary embodiment, the mating segments 24 are retractable from the extended position along the connection axes 56. Each mating segment 24 is retractable along the corresponding connection axis 56 in a direction generally toward the dielectric insert 32, which is represented by the arrow A in FIG. 4. In other words, as the mating segment 24 retracts along the connection axis 56, a tip 68 of the mating segment 24 moves along the connection axis 56 in a direction generally toward the dielectric insert 32.

Figure 5:
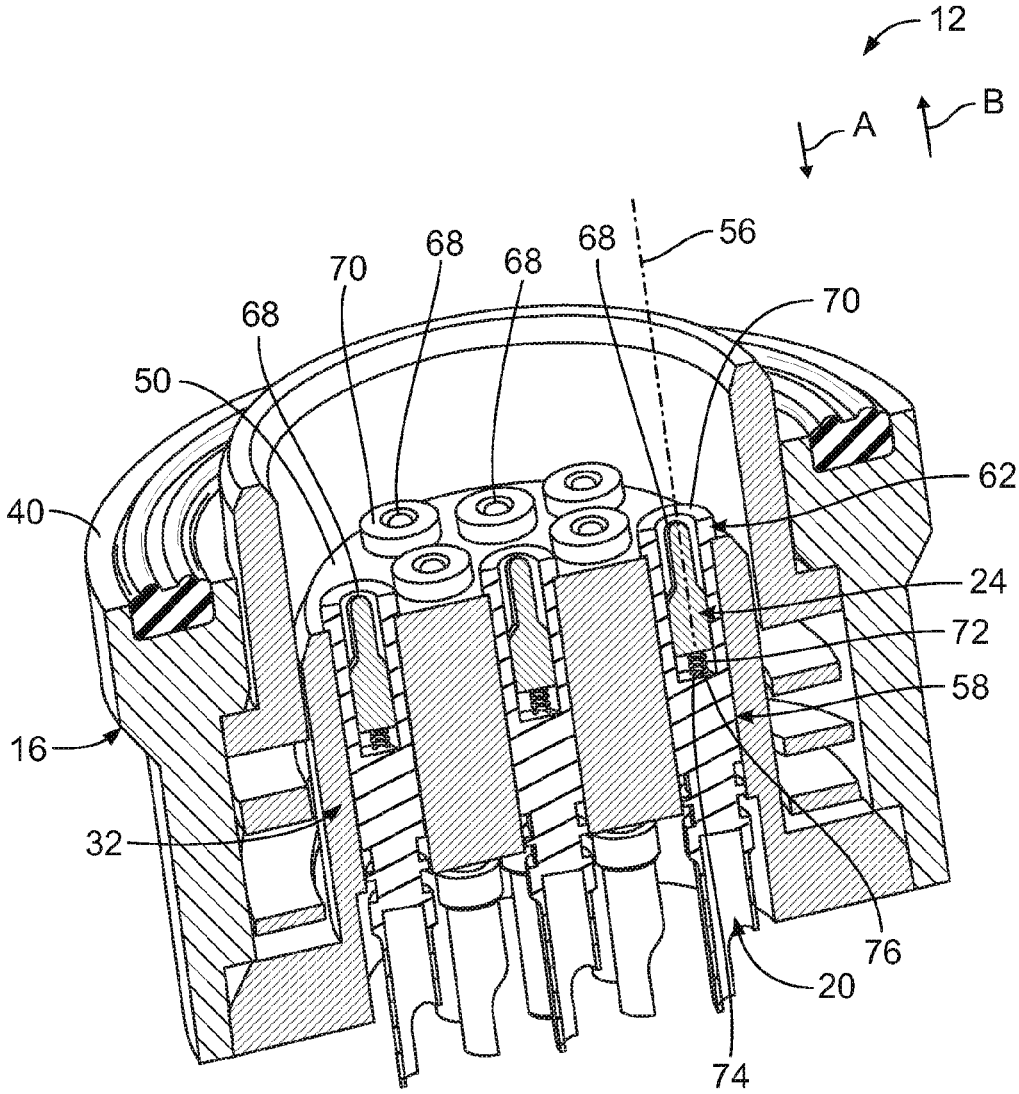
FIG. 5 is another perspective view of a cross section of the electrical connector shown in FIGS. 2-4 illustrating exemplary embodiments of electrical contacts in exemplary embodiments of retracted positions.

FIG. 5 is another perspective view of a cross section of the electrical connector 12 the mating segments 24 of the electrical contacts 20 in exemplary embodiments of retracted positions. The mating segments 24 have moved along the connection axes 56 in the direction A from the extended positions shown in FIG. 4 to the retracted positions shown in FIG. 5. In the retracted position, the tip 68 of the mating segment 24 is aligned along the axis 56 with, or spaced apart along the axis 56 in the direction A from, an end face 70 of the corresponding intermediate segment 58. But, in other embodiments of the retracted position, the tip 68 is spaced apart from the end face 70 along the connection axis 56 in the direction of the arrow B. In some embodiments of the retracted position, the tip 68 of the mating segment 24 is aligned along the axis 56 with, or spaced apart along the axis 56 in the direction of the arrow A from, the end face 50 of the dielectric insert 32. In some embodiments of the retracted position, the tip 68 of the mating segment 24 is aligned along the axis 56 with, or spaced apart along the axis 56 in the direction of the arrow A from, the mating face 40 of the housing 16.

As can be seen in FIG. 5, in the exemplary embodiment, the end 62 of the intermediate segment 58 extends outwardly from the end face 50 of the dielectric insert 32. In other words, the end face 70 of the intermediate segment 58 is spaced apart from the end face 50 along the corresponding connection axis 56 in the direction of the arrow B. But, in other embodiments, the end face 70 is aligned along the axis 56 with, or spaced apart along the axis 56 in the direction A from, the end face 50.

Referring now to FIGS. 4 and 5, in the exemplary embodiment, the mating segments 24 of the electrical contacts 24 move between the extended and retracted positions by being slidably received within interior compartments 72 of the corresponding intermediate segments 58. But, any other suitable arrangement that enables the mating segments 24 to move between the extended and retracted positions may be provided. For example, the mating segment 24 may include an interior cavity (not shown) that is configured to receive the corresponding intermediate segment 58 at least partially therein such that the mating segment 24 is configured to slide over the intermediate segment 58 between the extended and retracted positions.

The electrical connector 12 optionally includes one or more biasing mechanisms 74 that are configured to bias, or urge, the mating segments 24 to the extended positions. The mating segments 24 are movable from the extended positions to the retracted positions against the bias provided by the biasing mechanisms 74. The retracted positions of the mating segments 24 may be at the end of a range of travel of the biasing mechanisms 74. Additionally or alternatively, a stop or other structure (not shown) may be provided for limiting the range of movement of the mating segments 24 along the axes 56 in the direction of the arrow A.

In the exemplary embodiment, the biasing mechanisms 74 are held within the interior compartments 72 between the mating segments 24 and shoulders 76 of the intermediate segments 58. But, any other suitable arrangement that enables the biasing mechanisms 74 to function as described and/or illustrated herein may be provided. Although the biasing mechanisms 74 are illustrated as coil springs, each biasing mechanism 74 may additionally or alternatively include any other type of biasing mechanism, such as, but not limited to, leaf springs, wave springs, spring arms, spring tabs, and/or the like.

Referring again to FIGS. 2 and 3, the hood 28 is held by the housing 16. The hood 28 includes a base 78 (not visible in FIG. 2) and one or more walls 80 that extend outwardly from the base 78 along the central longitudinal axis 30. The hood 28 extends a length along the central longitudinal axis 30 from the base 78 to an end 82 of the wall 80. The end 82 of the wall 80 includes a tip 84. The base 78 may include a flange 86 (not visible in FIG. 2) that extends radially outward relative to the central longitudinal axis 30. Although only one wall 80 is shown herein, the hood 28 may include any number of walls 80.

Referring now to FIGS. 2 and 4, the hood 28 is held by the housing 16 such that, when the hood 28 is in an extended position (e.g., as shown in FIGS. 2 and 4), the hood 28 extends a length outwardly relative to the end face 50 of the dielectric insert 32 and relative to the mating face 40 of the housing 16. In other words, when the hood 28 is in the extended position, the tip 84 of the hood 28 is spaced apart from the end face 50 and the mating face 40 along the central longitudinal axis 30 in the direction of the arrow B. When the hood 28 is in the extended position and the mating segments 24 of the electrical contacts 20 are in the extended positions, the wall 80 of the hood 28 extends at least partially around the mating segments 24. In other words, the length of the hood 28 from the base 78 to the tip 84 defines a cavity 88 within which the lengths of the mating segments 24 extend when the hood 28 and the mating segments 24 are in the extended positions. In the exemplary embodiment, the wall 80 is a continuous wall that extends around an approximate entirety of the circumference of the mating segments 24 when the hood 28 is in the extended position. But, the wall 80 of the hood 28 may alternatively extend around only one or more portions of the circumference of the mating segments 24, whether or not the wall 80 is composed of a single wall or two or more walls wherein adjacent walls may and/or may not be interconnected.

Referring now solely to FIG. 4, in the exemplary embodiment, the tip 84 of the hood 28 is spaced apart along the axis 30 from the tips 68 of the mating segments 24 in the direction of the arrow B when the hood 28 and the mating segments 24 are in the extended positions. In some other embodiments, one or more of the tips 68 is aligned along the axis 30 with, and/or spaced apart along the axis 30 in the direction of the arrow B from, the tip 84 when the hood 28 and the mating segments 24 are in the extended positions.

Optionally, the hood 28 is configured to move, or slide, along the connection axes 56 between the extended position and a retracted position. Specifically, the hood 28 is retractable along the connection axes 56 from the extended position to a retracted position wherein at least a portion of the length of the hood 28 is retracted relative to the end face 50 of the dielectric insert 32. As shown in FIGS. 2-5, the hood 28 is in the extended position.

The hood 28 is retractable along the connection axes 56 in the direction A, which is generally toward the dielectric insert 32. In other words, as the hood 28 retracts from the extended position toward the retracted position, the tip 84 of the hood 28 moves along the connection axes 56 in a direction generally toward the dielectric insert 32.

Figure 6:
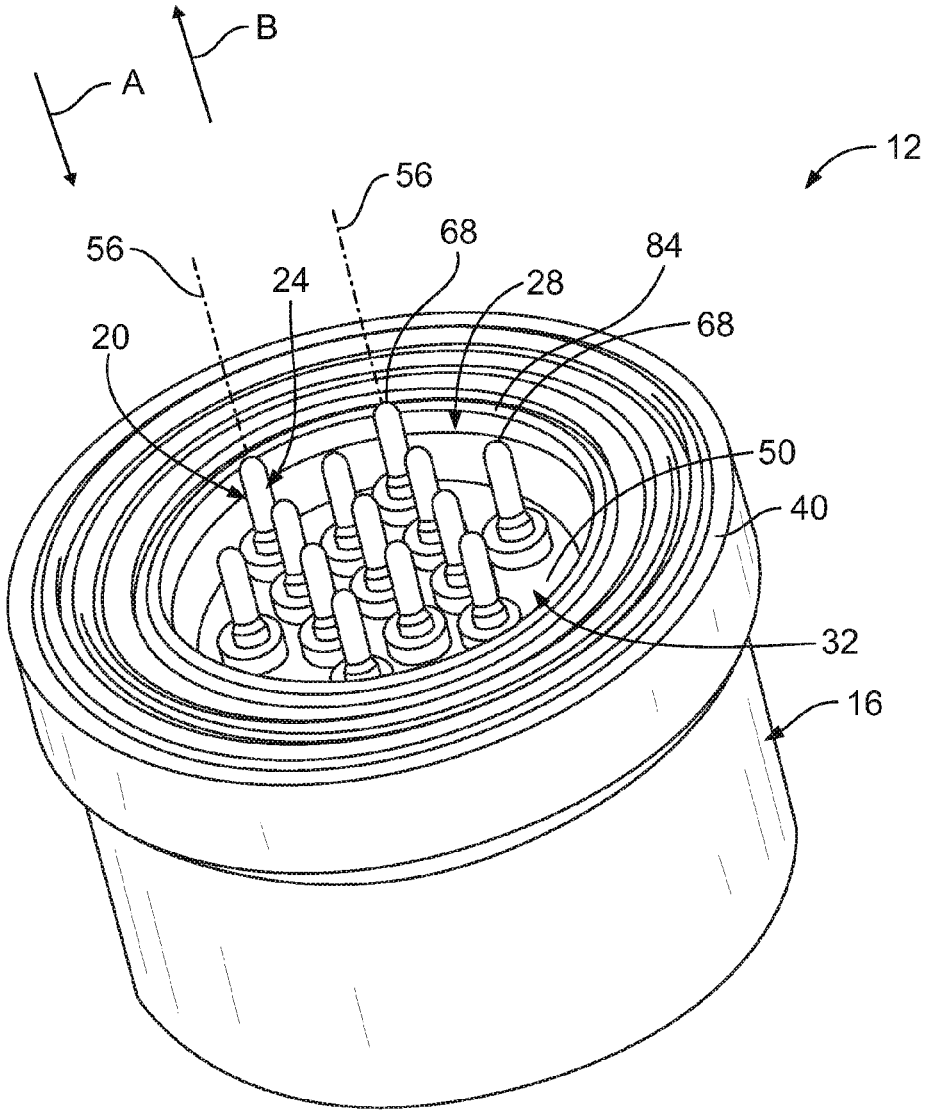
FIG. 6 is a perspective view of the electrical connector shown in FIGS. 2-5 illustrating an exemplary embodiment of a hood in an exemplary embodiment of a retracted position.
Figure 7:
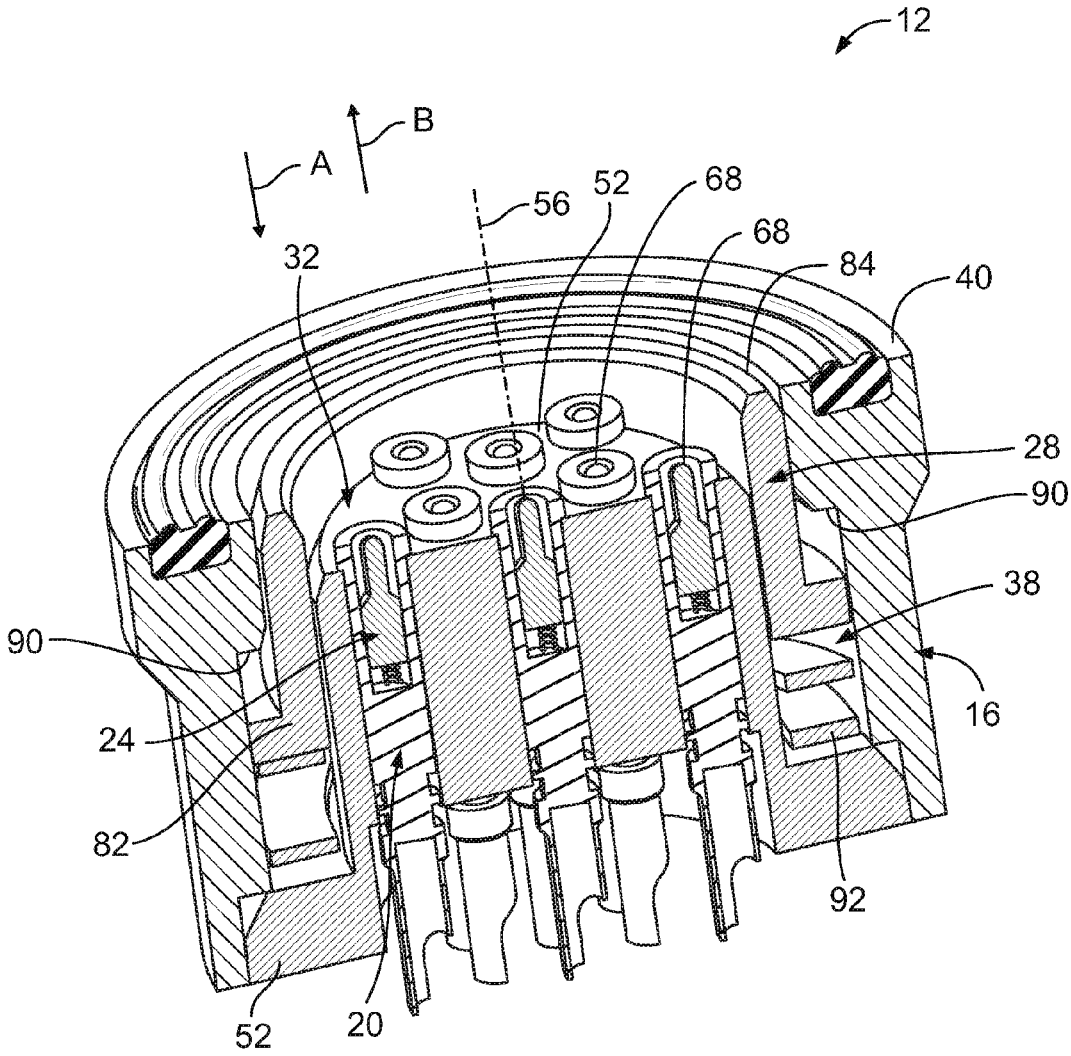
FIG. 7 is a perspective view of a cross section of the electrical connector shown in FIGS. 2-6 illustrating both the electrical contacts and the hood in the exemplary embodiments of the retracted positions.

FIG. 6 is a perspective view of the electrical connector 12 illustrating the hood 28 in an exemplary embodiment of a retracted position. FIG. 7 is a perspective view of a cross section of the electrical connector 12 illustrating both the hood 28 and the mating segments 24 of the electrical contacts 20 in the exemplary embodiments of the retracted positions. The mating segments 24 of the electrical contacts 20 are shown in the extended positions in FIG. 6. Referring now to FIGS. 6 and 7, the hood 28 has moved along the connection axes 56 in the direction A from the extended position shown in FIG. 4 to the retracted position shown in FIGS. 6 and 7.

Figure 8:
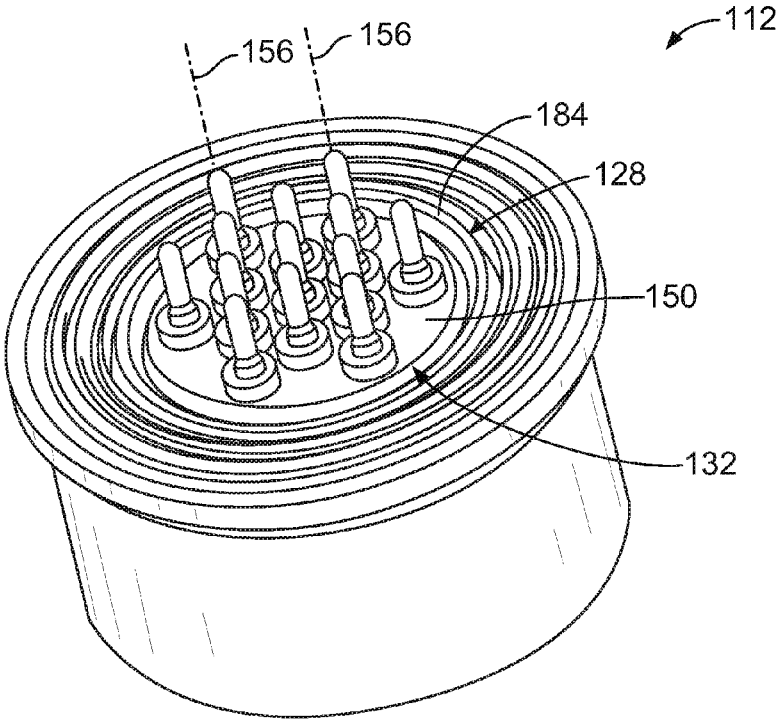
FIG. 8 is a perspective view of another exemplary embodiment of an electrical connector.

In the retracted position, the tip 84 of the hood 28 is aligned along the axes 56 with the mating face 40 of the housing 16. But, in other embodiments of the retracted position, the tip 84 of the hood 28 is spaced apart from the mating face 40 along the connection axes 56 in the direction of the arrow B or is spaced apart from the mating face 40 along the axes 56 in the direction A. In the exemplary embodiment of the retracted position, the tip 84 of the hood 28 is spaced apart along the axes 56 in the direction of the arrow B from the end face 50 of the dielectric insert 32. But, in other embodiments of the retracted position, the tip 84 of the hood 28 is aligned along the axes 56 with, or spaced apart along the axes 56 in the direction of the arrow A from, the end face 50 of the dielectric insert 32 (whether or not the end face 50 is aligned along the axes 56 with the mating face 40). For example, FIG. 8 is a perspective view of another exemplary embodiment of an electrical connector 112 having a hood 128 that is moveable between an extended position (not shown) and a retracted position (shown in FIG. 8). In the exemplary embodiment of the retracted position of the hood 128, a tip 184 of the hood 128 is aligned along connection axes 156 with an end face 150 of a dielectric insert 132 of the electrical connector 112.

Referring now solely to FIG. 6, in the exemplary embodiment of the retracted position, the tip 84 of the hood 28 is spaced apart along the axes 56 in the direction A from the tips 68 of the mating segments 24 of the electrical contacts 20 when the mating segments 24 are in the extended positions. But, in other embodiments of the retracted position, the tip 84 of the hood 28 is aligned with along the axes 56, or is spaced apart along the axes 56 in the direction B from, the tips 68 of the mating segments 24 when the mating segments 24 are in the extended positions.

Referring now solely to FIG. 7, in the exemplary embodiment of the retracted position, the tip 84 of the hood 28 is spaced apart along the axes 56 in the direction B from the tips 68 of the mating segments 24 of the electrical contacts 20 when the mating segments 24 are in the retracted positions. But, in other embodiments of the retracted position, the tip 84 of the hood 28 is aligned with along the axes 56 with, or is spaced apart along the axes 56 in the direction A from, the tips 68 of the mating segments 24 when the mating segments 24 are in the retracted positions.

In the exemplary embodiment, the hood 28 moves between the extended and retracted positions by being slidably received within the interior compartment 38 of the housing 16 between the dielectric insert 32 and the housing 16. But, any other suitable arrangement that enables the hood 28 to move between the extended and retracted positions may be provided. The flange 82 of the hood 28 may engage a shoulder 90 of the housing 16 when the hood 28 is in the extended position to limit the range of movement of the hood 28 in the direction of the arrow B.

The electrical connector 12 optionally includes one or more biasing mechanisms 92 (also shown in FIG. 3) that are configured to bias, or urge, the hood 28 to the extended position. The hood 28 is movable from the extended position to the retracted position against the bias provided by the biasing mechanism 92. The retracted position of the hood 28 may be at the end of a range of travel of the biasing mechanism 92. Additionally or alternatively, a stop or other structure (not shown) may be provided for limiting the range of movement of the hood 28 in the direction of the arrow A. In the exemplary embodiment, the biasing mechanism 92 is held within the interior compartment 38 of the housing 16 between the flange 52 of the dielectric insert 32 and the flange 86 of the hood 28. But, any other suitable arrangement that enables the biasing mechanism 92 to function as described and/or illustrated herein may be provided. Although the biasing mechanism 92 is illustrated as a wave spring, the biasing mechanism 92 may additionally or alternatively include any other type of biasing mechanism, such as, but not limited to, leaf springs, coils springs, spring arms, spring tabs, and/or the like.

The retracted position of the hood 28 and/or the retracted positions of the mating segments 24 of the electrical contacts 20 may enable the electrical connector 12 to be more easily cleaned without damaging the electrical contacts 20. For example, and as shown in FIG. 6, the hood 28 can be retracted to expose the mating segments 24 in the extended positions of the mating segments 24. Mud, sand, dirt, dust, and/or other debris may then be removed from between the mating segments 24, for example using a person's hand, water, air, cleaning fluid, and/or the like. Moreover, and for example, the mating segments 24 of the electrical contacts 20 can be retracted, as is shown in FIG. 7. With the mating segments 24 retracted, for example as shown in FIG. 7, any mud, sand, dirt, dust, and/or other debris that has accumulated between the mating segments 24 can be removed by cleaning the end face 50 of the dielectric insert 32.

Figure 9:
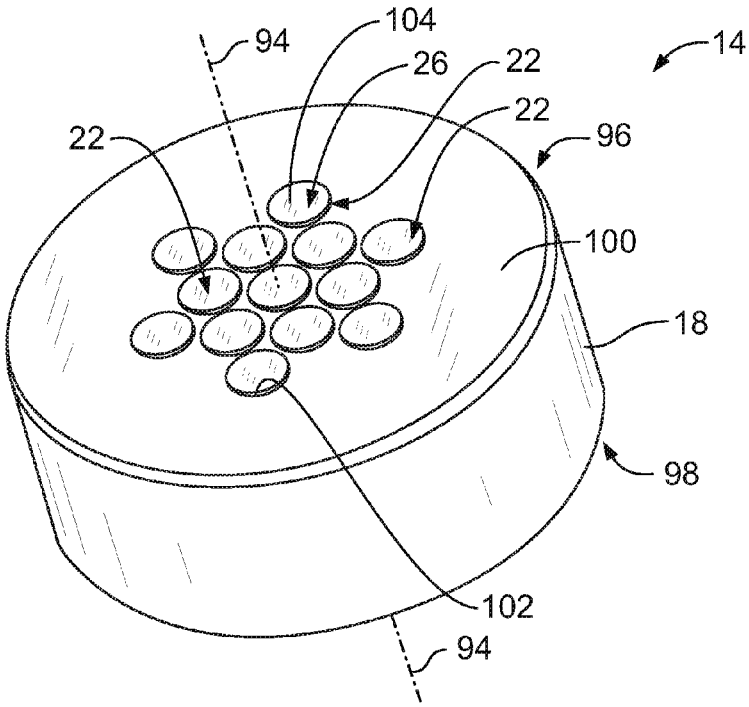
FIG. 9 is a perspective view of an exemplary embodiment of another electrical connector of the connector system shown in FIG. 1.

FIG. 9 is a perspective view of an exemplary embodiment of the electrical connector 14. The electrical connector 14 includes the housing 18 and the electrical contacts 22. The housing 18 extends a length along a central longitudinal axis 94 from an end 96 to an opposite end 98. The end 96 of the housing 18 includes a mating face 100 that faces the housing 16 (FIGS. 1-7) of the electrical connector 12 (FIGS. 1-7) when the electrical connectors 12 and 14 are mated together. One or more contact openings 102 extend through the length of the housing 18. The contact openings 102 are configured to hold corresponding electrical contacts 22 of the electrical connector 14 therein. The housing 18 may include any number of the contact openings 102 for holding any number of electrical contacts 22.

The electrical contacts 22 of the electrical connector 14 are held within the contact openings 102 of the housing 18. Each electrical contact 22 includes the mating segment 26. In the exemplary embodiment, tips 104 of the mating segments 26 are aligned along the central longitudinal axis 94 with the mating face 100 of the housing 18. But, in other embodiments, one or more of the tips 104 of the mating segments 26 extends a length outwardly from the mating face 100 of the housing 18 and/or is recessed relative to the mating face 100.

Each electrical contact 22 may be a signal contact, a ground contact, or an electrical power contact. Although thirteen are shown, the electrical connector 14 may include any number of the electrical contacts 22. In the exemplary embodiment, the mating segment 26 of each electrical contact 22 is a pad, however, each mating segment 26 may additionally or alternatively include any other structure, type of contact, and/or the like, such as, but not limited to, a pin, a spring, a receptacle, an arm, a tab, and/or the like.

Referring again to 1, each electrical contact 22 includes an intermediate segment 106 that extends within the corresponding contact opening 102. The intermediate segments 106 optionally include one or more retention features (not shown) that facilitate holding the intermediate segments 106 within the contact openings 102, for example with a snap or interference fit connection. Each electrical contact 22 includes a termination segment 108. The termination segment 108 is configured to be electrically connected to an electrical component, such as, but not limited to, an electrical wire, an electrical cable, another electrical contact, a circuit board, an electrical device, and/or the like.

When the electrical connectors 12 and 14 are mated together, for example as shown in FIG. 1, the mating segments 24 of the electrical contacts 20 engage the mating segments 26 of the electrical contacts 22 to electrically interconnect the electrical connectors 12 and 14. Optionally, the mating face 100 of the housing 18 of the electrical connector 14 is engaged with the seal 44 and/or the mating face 40 of the housing 16 of the electrical connector 12 when the connectors 12 and 14 are mated together. The hood 28 is optionally configured to retract from the extended position toward the retracted position during mating of the electrical connector 12 with the electrical connector 14, for example via engagement with the electrical connector 14. The mating segments 24 of the electrical contacts are optionally configured to retract from the extended positions toward the retracted positions during mating of the electrical connectors 12 and 14, for example via engagement with the electrical contacts 22.

Although shown as having generally cylindrical shapes, each of the electrical connectors 12 and 14, and each of any individual components thereof, may additionally or alternatively include any other shape.

Figure 10:
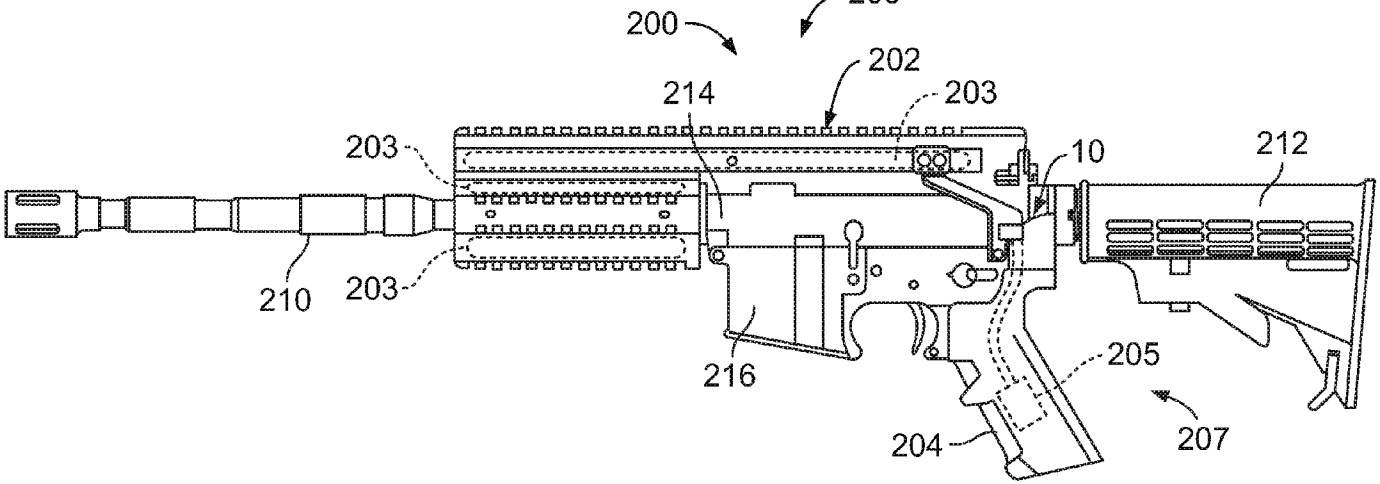
FIG. 10 is a side elevational view of an exemplary embodiment of a weapon with which the connector system shown in FIG. 1 may be used.
Figure 11:
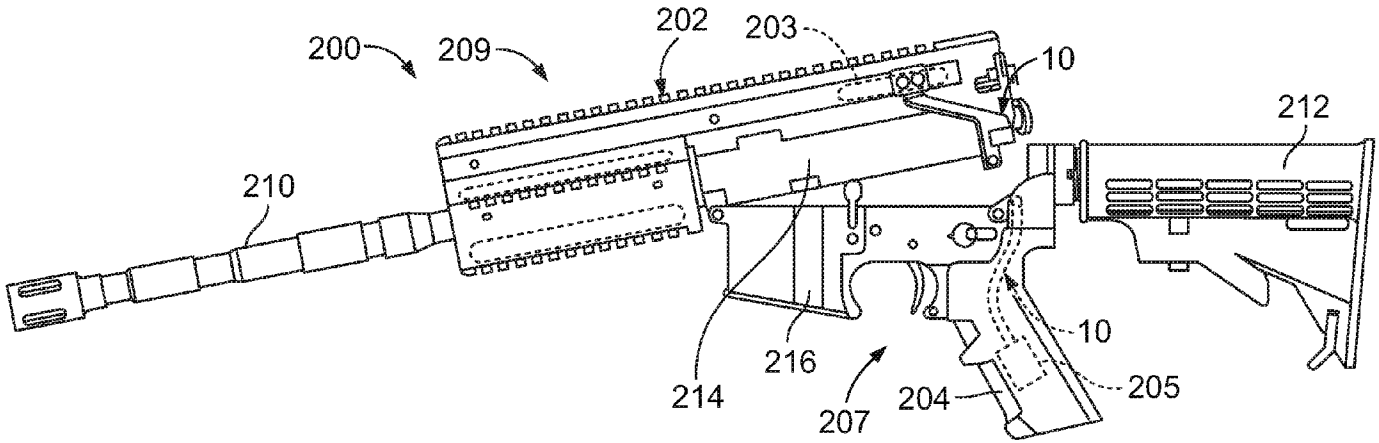
FIG. 11 is a side elevational view of the weapon shown in FIG. 10 illustrating the weapon in an open state.

FIG. 10 is a side elevational view of an exemplary embodiment of a weapon 200 with which the connector system 10 may be used. The weapon 200 is illustrated in a closed state in FIG. 10. FIG. 11 is a side elevational view of the weapon 200 in an open state. In the exemplary embodiment, the weapon 200 is an AR-15 style weapon, however the weapon 200 is not limited to AR-15 style weapons. Rather, the weapon 200 may be any other type of weapon with which an electrical connector may be used.

In the exemplary embodiment, the weapon 200 is of a type that includes a rail 202 having electronics 203 therein and a lower part, or base, 207 having electronics 205 therein. The weapon 200 includes an upper part 209 that is coupled to the base 207. The upper part 109 includes the rail 202, a barrel 210, and an upper receiver 214. The base 207 includes a hand grip 204, a lower receiver 216 and a butt stock 212. The electronics 205 may be housed in any of the hand grip 204, the lower receiver 216 and/or the butt stock 212. The base 207 may include other components of the weapon 200. The upper part 109 may include other components of the weapon 200.

The weapon 200 includes the connector system 10, which electrically connects the electronics 205 of the base 207 with the electronics 203 associated with the rail 202. The communication connector system 10 transmits electrical power and/or electrical data between the rail 202 and the base 207. The connector system 10 includes the electrical connectors 12 and 14 (FIGS. 1-7 and 9 and FIGS. 1 and 9, respectively), which are easily and repeatedly mated and unmated as the weapon 200 is moved between the closed state (shown in FIG. 10) and the open state (shown in FIG. 11). In some embodiments, the base 207 may include the electrical connector 12, while the upper part 209 includes the electrical connector 14. In other embodiments, the base 207 includes the electrical connector 14 and the upper part 209 includes the electrical connector 12.

The connector system 10 may also include an external connector (not shown) for interfacing with an external connector, such as an electrical connector and/or fiber optic connector provided at an end of cable extending from the user of the weapon 200. Data and/or power may be transmitted to and/or from the user and the weapon 200 via the external connector. The communication connector system 10 connectorizes the interface between the base 207 and the rail 202.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing comprising an internal compartment;

a dielectric insert held within the internal compartment of the housing, the dielectric insert comprising an end face;

an electrical contact held by the dielectric insert, the electrical contact comprising a mating segment that extends a length outwardly from the end face of the dielectric insert along a connection axis, the electrical contact comprising an intermediate segment, wherein the mating segment is slidably received within the intermediate segment such that the mating segment is configured to retract from an extended position of the mating segment toward a retracted position of the mating segment; and a hood held by the housing, the hood having an extended position relative to the end face of the dielectric insert wherein the hood extends a length outwardly relative to the end face, the hood extending at least partially around the mating segment of the electrical contact in the extended position of the hood, wherein the hood is retractable along the connection axis from the extended position of the hood to a retracted position of the hood wherein at least a portion of the length of the hood is retracted relative to the end face of the dielectric insert.

2. The electrical connector of claim 1, further comprising a biasing mechanism held by the housing, the biasing mechanism being configured to urge the hood to the extended position.

3. The electrical connector of claim 1, wherein the housing comprises a mating face, the hood extending a length from a base to an end, the end of the hood comprising a tip that is approximately aligned with the mating face of the housing when the hood is in the retracted position.

4. The electrical connector of claim 1, wherein the hood defines a cavity within which the mating segment of the electrical contact extends when the hood is in the extended position.

5. The electrical connector of claim 1, wherein the hood comprises a continuous wall that extends around an approximate entirety of the circumference of the mating segment of the electrical contact when the hood is in the extended position.

6. The electrical connector of claim 1, further comprising a wave spring held by the housing, the wave spring being configured to urge the hood to the extended position.

7. The electrical connector of claim 1, wherein the hood is configured to retract from the extended position toward the retracted position during mating of the electrical connector with a mating connector.

8. The electrical connector of claim 1, wherein the mating segment of the electrical contact comprises a pin.

9. The electrical connector of claim 1, wherein the hood extends a length from a base to an end, the end of the hood being approximately aligned with the end face of the dielectric insert when the hood is in the retracted position.

10. The electrical connector of claim 1, wherein the mating segment of the electrical contact is biased to the extended position by a spring that is a discrete component from the mating and intermediate segments of the electrical contact.

11. The electrical connector of claim 1, wherein the mating segment of the electrical contact is configured to retract from the extended position toward a retracted position during mating of the electrical connector with a mating connector.

12. The weapon of claim 11, wherein the mating segment of the electrical contact is biased to the extended position by a spring that is a discrete component from the mating and intermediate segments of the electrical contact.

13. A weapon comprising:

a base having a lower receiver, the base housing electronics therein;

an upper part having an upper receiver that is removably attachable to the lower receiver, the upper part housing electronics therein; and a communication connector system communicatively connecting the electronics of the base with the electronics of the upper part, the communication connector system including upper and lower connectors coupled to the upper and lower receivers, respectively, the upper and lower connectors being communicatively connected to the electronics in the upper part and the base, respectively, wherein at least one of the upper connector or the lower connector comprises:

a housing comprising an internal compartment;

a dielectric insert held within the internal compartment of the housing;

an electrical contact held by the dielectric insert, the electrical contact comprising a mating segment that extends a length outwardly from the dielectric insert; and a hood held by the housing, the hood having an extended position relative to the dielectric insert, the hood extending at least partially around the mating segment of the electrical contact in the extended position, wherein the hood is retractable from the extended position to a retracted position wherein at least a portion of the length of the hood is retracted relative to the dielectric insert.

14. The weapon of claim 13, wherein at least one of the upper connector or the lower connector further comprises a biasing mechanism held by the housing, the biasing mechanism being configured to urge the hood to the extended position.

15. The weapon of claim 13, wherein the hood comprises a continuous wall that extends around an approximate entirety of a circumference of the mating segment of the electrical contact when the hood is in the extended position.

16. The weapon of claim 13, wherein the electrical contact comprises an intermediate segment and the mating segment of the electrical contact is slidably received within the intermediate segment such that the mating segment is configured to retract from an extended position of the mating segment toward a retracted position of the mating segment.

17. An electrical connector comprising:

a housing comprising an internal compartment;

a dielectric insert held within the internal compartment of the housing, the dielectric insert comprising an end face;

an electrical contact held by the dielectric insert, the electrical contact comprising a mating segment that extends a length outwardly from the end face of the dielectric insert along a connection axis, the electrical contact comprising an intermediate segment, the mating segment being retractable along the connection axis in a direction generally toward the dielectric insert wherein the mating segment is slidably received within the intermediate segment for retracting from the extended position of the mating segment; and a hood held by the housing, the hood having an extended position relative to the end face of the dielectric insert wherein the hood extends a length outwardly relative to the end face, the hood extending at least partially around the mating segment of the electrical contact in the extended position, wherein the hood is retractable along the connection axis from the extended position to a retracted position wherein at least a portion of the length of the hood is retracted relative to the end face of the dielectric insert.

18. The electrical connector of claim 17, wherein the mating segment of the electrical contact is configured to retract from the extended position toward a retracted position during mating of the electrical connector with a mating connector.

19. The electrical connector of claim 17, wherein the the mating segment of the electrical contact extends the length to a tip, the tip of the mating segment being approximately aligned with at least one of an end face of the intermediate segment or the mating face of the housing when the mating segment is in a retracted position.

20. The electrical connector of claim 17, wherein the mating segment of the electrical contact is biased to the extended position by a spring that is a discrete component from the mating and intermediate segments of the electrical contact.

* * * * *